US006033987A

United States Patent [19]

Lin et al.

[11] Patent Number: 6,033,987

[45] Date of Patent: Mar. 7, 2000

[54] METHOD FOR MAPPING AND ADJUSTING PRESSURE DISTRIBUTION OF CMP PROCESSES

[75] Inventors: Chi-Fa Lin, Hsinchu; Wen-Tsu Tseng, Tainan; Min-Shinn Feng, Hsinchu, all of Taiwan

[73] Assignee: Winbond Electronics Corp., Hsinchu, Taiwan

[21] Appl. No.: 09/232,179

[22] Filed: Jan. 15, 1999

[51] Int. Cl.[7] ..... H01L 21/302

[52] U.S. Cl. ..... 438/692; 438/692; 438/633; 438/747; 451/41; 451/285; 451/384; 216/88; 156/345

[58] Field of Search ..... 438/692, 633, 438/747; 451/41, 285, 384; 216/88; 156/345

[56] References Cited

U.S. PATENT DOCUMENTS 5,725,420 3/1998 Torii ..... 451/285

5,931,719 8/1999 Nagahara et al. ..... 451/41

5,958,794 9/1999 Bruxvoort et al. ..... 438/692

*Primary Examiner*—Benjamin Utech

*Assistant Examiner*—Lan Vinh

*Attorney, Agent, or Firm*—W. Wayne Liauh

[57] ABSTRACT

A method for chemically-and-mechanically polishing a semiconductor wafer surface is disclosed. It includes the steps of: (a) providing a mechanical polishing pad; (b) placing a pressure-sensitive film on top of a wafer surface to be polished by the mechanical polishing pad, the pressure-sensitive film contains materials that will show pressure-dependent colors when subject to an external pressure; (c) commencing a chemically-and-mechanically polishing process so that the mechanical polishing pad exerts a pressure on the pressure-sensitive film; (d) scanning the pressure-dependent color pattern on the pressure-sensitive film; (e) converting the pressure-dependent color pattern into a pressure distribution; and (f) adjusting the mechanical polishing pad, or a leveling of the wafer mounting, or both, according to the pressure distribution obtained in step (e).

14 Claims, 2 Drawing Sheets

METHOD FOR MAPPING AND ADJUSTING PRESSURE DISTRIBUTION OF CMP PROCESSES

FIELD OF THE INVENTION

The present invention relates to an improved chemical-mechanical planarization (CMP) process for the fabrication of ultra-large-scale integrated (ULSI) circuits. More specifically, the present invention relates to a method which allows the pressure distribution during a CMP process to be measured on a real-time basis, so as to allow the semiconductor manufacturer to effectuate a more precise adjustment of the pressure distribution that the CMP polishing head exerts on the wafer surface. The precess disclosed in the present invention can substantially improve the CMP process by making it more of a science.

BACKGROUND OF THE INVENTION

In the fabrication of ultra-large-scale integrated (ULSI) circuits, vertical stacking, or integration, of a plurality of metal wiring circuits, or metal layers, to form a multilevel interconnection has become an efficient way to improve circuit performance and increase the functional complexity of the circuits. One drawback of multilevel interconnection is the loss of topological planarity resulting from various photolithographic and etching processes. To alleviate these problems, the wafer is planarized at various stages in the fabrication process to minimize non-planar topography and thus its adverse effects. Such planarization is typically implemented in the dielectric layers.

More recently, chemical-mechanical polishing (CMP) processes have become very well received to planarize the wafer surface in preparation for further device fabrication. The CMP process mainly involves holding a semiconductor wafer against a rotating polishing pad surface wetted by a polishing slurry, which typically comprises an acidic or basic etching solution in combination with alumina or silica particles. On the one hand, the liquid portion of the slurry chemically removes, loosens, or modifies the composition of the material on the wafer which is to be removed. On the other hand, the particle portion of the slurry, in combination of the rotating polishing pad, physically removes the chemical modified material from the wafer. Thus, the name chemical-mechanical polishing was obtained.

CMP processes have been used to polish surfaces that are made of silicon oxide, silicon nitride, aluminum, copper, tungsten, etc. At the present time, the mechanical force distribution on the CMP polishing head is adjusted on a post-priori manner, i.e., by examining the CMP-polished surface and then adjust the CMP polishing head on a trial-and-error, or, at best, an empirical, manner. There is no available technique that exists today that will allow the semiconductor manufacturer to measure, obtain a feedback, and then adjust and control the distribution of the mechanical force exerted by the CMP polishing head on the wafer surface.

What makes the adjustment process difficult is that there exist many other factors that can also affect the result of a CMP process. These include the overall pressure, polishing temperature, slurry composition, wafer material, circuit pattern, the type of sacrificial material used for planarization, etc. By only examining the polished surface, it is essentially impossible to isolate the effect of one factor from the others. As a result, the CMP process is often described as an "art" and not considered as a "science". In other words, the CMP processes are typically adjusted based on empirical experience and not probed in a scientific manner.

With the significant advancement of the semiconductor fabrication process, it is important to reduce such empiricism and elevate our understanding of the CMP process as much as possible. It is particularly desirable to develop a method which will allow semiconductor manufacturers to understand the pressure distribution on the CMP head, so as to allow proper adjustment to be made so as to optimize and improve the CMP process.

SUMMARY OF THE INVENTION

The primary object of the present invention is to develop an improved CMP process which will allow the distribution of its mechanical forces to be precisely measured so as to allow optimal adjustments to be made. More specifically, the primary object of the present invention is to develop a technique which will allow the pressure distribution exerted by a CMP polishing head to be measured on a localized and real-time basis. The information so obtained can be utilized advantageously to fine-tune a CMP process, as well as to design a better CMP machine. But most importantly, the present invention allows the semiconductor manufacturers to obtain a better understanding of the CMP process, so that it can be a science and not just an art.

In the present invention, a pressure-sensitive film is cut to the size of a wafer, which is scheduled to be CMP polished, and placed on the surface of the wafer. The wafer is then briefly subject to a CMP polishing action during which the CMP polishing head will exert a pressure on the pressure-sensitive film. Thereafter, the CMP polishing head is removed and a color pattern will develop on the pressure-sensitive film. The color pattern on the pressure-sensitive film can be scanned with an image scanner which then provides a direct indication of the local distribution of pressure or mechanical force exerted by the CMP polishing head.

The pressure-sensitive film typically comprises a pair of polymer bases, each of which being typically a polyester base, and a micro-encapsulated color forming layer and a matching color developing layer sandwiched by the pair of polyester bases. When pressure is applied on the pressure-sensitive film, some of the microcapsules are broken and the color-forming material is released which reacts with the color-developing material to generate color. The microcapsules are designed, through particle size control technology, to react to various degrees of pressure, releasing their color-forming material at a density that corresponds to the pressure. One example of such pressure-sensitive films is the Fuji Prescale Film manufactured by Fuji Corp. of Japan. However, the key element of the present invention is the use of pressure-sensitive films in CMP operations.

Other pressure-sensitive materials can be used in the present invention.

After the pressure distribution is obtained from the pressure-sensitive film, the level of the wafer can be adjusted if necessary so as to improve the pressure distribution. At the present time, a single pneumatic or liquid means is used to control the pressure over the entire CMP polishing head surface. In other words, with the current technology, the entire CMP polishing head has the same pressure. With the technique developed in the present invention, the CMP pressure zone can be divided into several sub-zones, each with a separate pressure control. After the pressure distribution is obtained and the wafer level adjusted, the pressure in each sub-zone can be separated adjusted so as to obtain the best CMP performance.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

The present discloses an improved CMP process which allows the distribution of its mechanical forces to be precisely measured so as to allow optimal adjustments to be made. More specifically, the present invention discloses a technique which allows the pressure distribution on a CMP polishing head to be measured on a localized and real-time basis. As discussed earlier, the present invention allows the semiconductor manufacturers to obtain a better understanding of the CMP process, so that the adjustment or "calibration" of the CMP process can become more of a science and less of an art. The information obtained from the process of the present invention can be utilized advantageously to better control a CMP process, as well as to design a better CMP machine.

Figure 1:
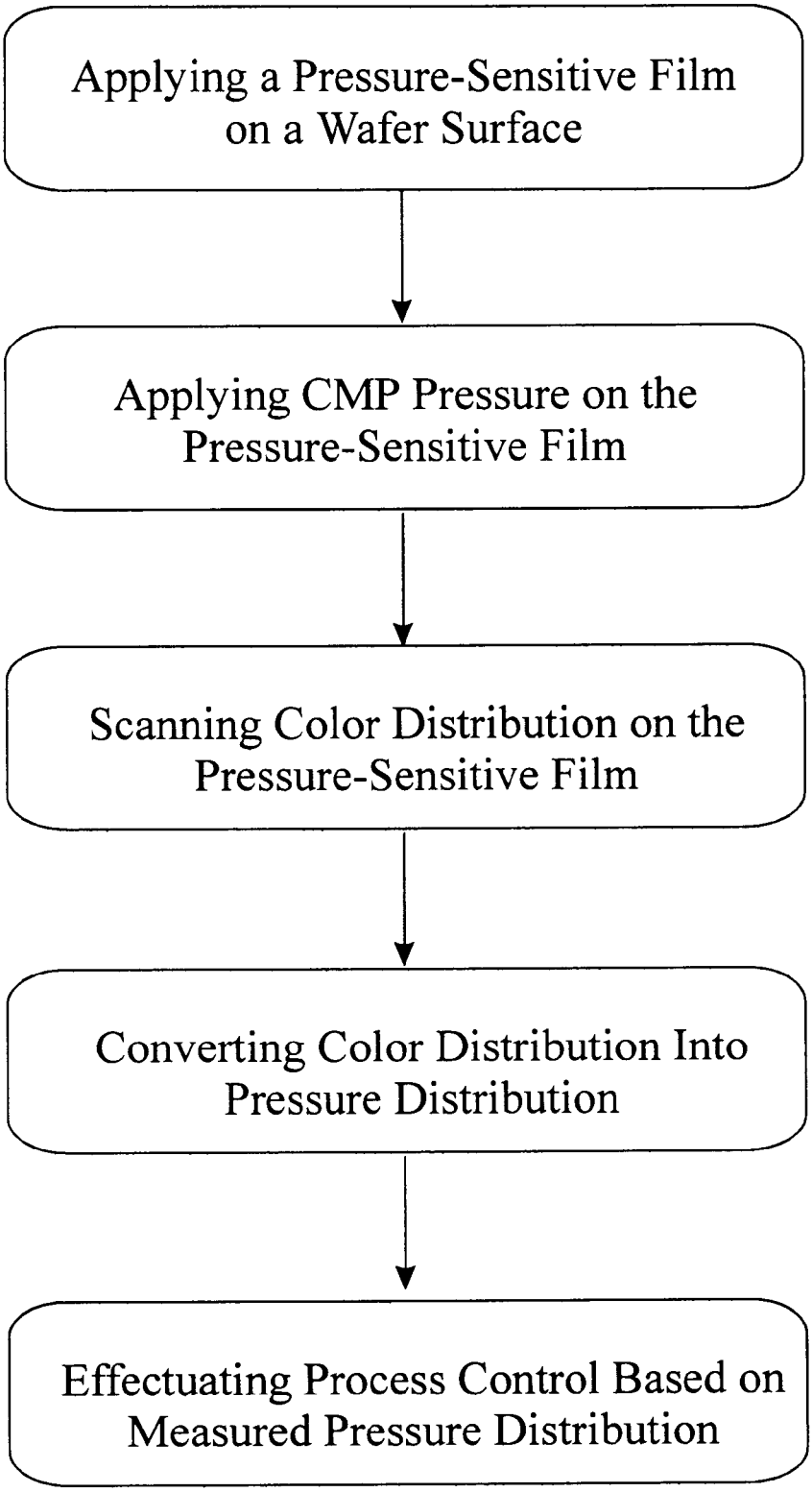
FIG. 1 is a schematic flowchart showing the main steps of the process disclosed in the present invention for measuring and adjusting pressure distribution on a real-time basis during a CMP polishing operation.

FIG. 1 shows a schematic flowchart of the main steps of the process disclosed in the present invention for measuring and adjusting pressure distribution on a real-time basis during a CMP polishing operation. In the first step, a pressure sensitive film is applied onto the wafer surface, then the CMP process is activated in step 2 to apply pressure on the pressure sensitive film. In step 3, the CMP polishing head is removed and the pressure-sensitive film is scanned for its color image. In Step 4, the color image is digitized using a simulator and then converted to pressure distribution data.

In step 5, the pressure data is fed back to a control unit, which adjusts the operation of the CMP process, including the level of the wafer and the polishing head, to achieve a more uniform pressure distribution. Optionally, the entire cycle of steps 1 through 5 can be repeated to ensure that a uniform pressure distribution is obtained.

The pressure-sensitive film typically comprises a pair of polymer bases, typically a polyester base, sandwiched by a micro-encapsulated (microcapsules) color forming layer and a color developing layer. When a pressure is applied on the pressure-sensitive film, the microcapsules are broken and the color-forming material that is released reacts with the color-developing material to generate color. The microcapsules, which are designed to have a predetermined particle size distribution, react to various degrees of pressure to release their color-forming material at a density that corresponds to the pressure, thus allowing a color pattern to be developed upon exposure to an external pressure. One example of such pressure-sensitive films is the Fuji Prescale Film manufactured by Fuji Film Co. of Japan. There are several types of Fuji Prescale Films each of which is designed to work at a specific pressure range. These are summarized in Table 1 below.

| Film Type | Pressure Range (MPa) |
|---|---|
| Ultra Super Low Pressure (LLLW) | 0.2–0.6 |
| Super Low Pressure (LLW) | 0.6–2.5 |
| Low Pressure (LW) | 2.5–10 |
| Medium Pressure (MW) | 10–50 |
| Medium Pressure (MS) | 10–50 |
| High Pressure (HS) | 50–130 |

However, it should be noted that the key element of the present invention is the use of pressure-sensitive films in CMP operations. Other pressure-sensitive materials can be used in the present invention.

At the present time, a pneumatic or liquid means is used to control the pressure over the entire CMP polishing head surface. In other words, with the current technology, the CMP polishing head has a uniform pressure. Thus, after the pressure distribution is obtained from the pressure-sensitive film, typically the wafer level is adjusted so as to improve the pressure distribution. This can be done with the aid of a simulator.

However, further improvement can be made with regard to the CMP process. With the technique developed in the present invention, the single CMP pressure zone that is currently available can be divided into several sub-zones, each with a separate pressure control. After the pressure distribution is obtained and after the wafer level is adjusted, the pressure in each sub-zone can be separated adjusted so as to obtain the best CMP performance.

Figure 2A:
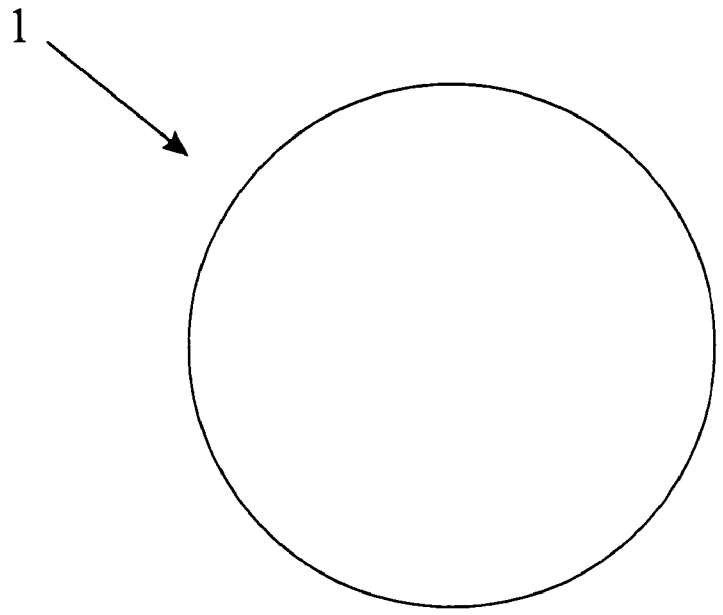
FIG. 2A is a schematic drawing showing the uniform pressure distribution that is with the current CMP polishing head.
Figure 2B:
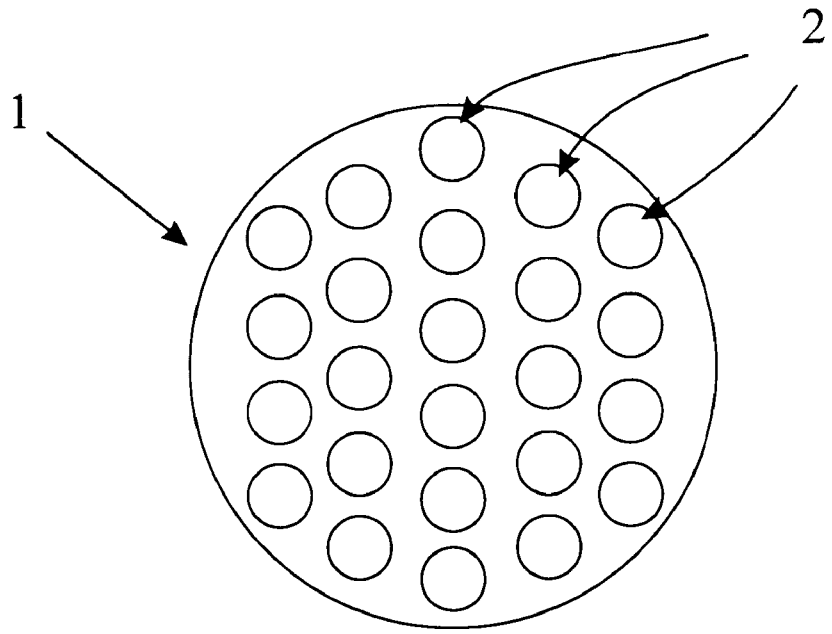
FIG. 2B is a schematic drawing showing that, with the pressure distribution that can be obtained from the process of the present invention, the CMP polishing head can be divided into a plurality of pressure zones, each with a separate pressure control so as to obtain an optimal distribution of mechanical force acting on the wafer surface.

Comparison of the prior art CMP polishing head and that from the present invention can be illustrated by comparing FIGS. 2A and 2B. In FIG. 2A it is shown the uniform pressure distribution observed from the current CMP polishing head 1. With the present invention, which allows the pressure distribution to be measured on a localized and real-time basis, the CMP polishing head 1 can be divided into a plurality of pressure zones2, as shown in FIG. 2*b,* each with a separate pressure control so as to obtain an optimal localized distribution of the pressure, or mechanical force, to be acting on the wafer surface.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for measuring a pressure distribution of a CMP (chemical-mechanical polishing) polishing pad exerted on a wafer surface, comprising the steps of:

(a) placing a pressure-sensitive film on top of a wafer surface to be planarized by a CMP polishing pad, said pressure-sensitive film contains materials that will show pressure-dependent characteristics when subject to an external pressure;

(b) commencing a CMP polishing process so that said CMP polishing pad exerts a pressure on said pressure-sensitive film;

(c) measuring said pressure-dependent characteristics on said pressure-sensitive film; and (d) converting said pressure-dependent characteristics into a pressure distribution.

2. The method for measuring a pressure distribution of a CMP polishing pad exerted on a wafer surface according to claim 1 wherein said pressure-sensitive film contains pressure-sensitive color materials that will show pressure-dependent colors when subject to an external pressure.

3. The method for measuring a pressure distribution of a CMP polishing pad exerted on a wafer surface according to claim 2 wherein said pressure-sensitive film contains a micro-encapsulated color forming layer and a color developing layer sandwiched by a pair of protective layers, and a color will be formed when said micro-encapsulated color forming layer is broken by an external pressure to release a color forming material which reacts with a color developing material contained in said color developing layer.

4. The method for measuring a pressure distribution of a CMP polishing pad exerted on a wafer surface according to claim 3 wherein said micro-encapsulated color forming layer is designed to contain a mixture microcapsules of different particle sizes so that their color-forming material will be released at a density that corresponds to the exerted pressure.

5. The method for measuring a pressure distribution of a CMP polishing pad exerted on a wafer surface according to claim 3 wherein said protective layer is a polymer layer.

6. The method for measuring a pressure distribution of a CMP polishing pad exerted on a wafer surface according to claim 3 wherein said protective layer is a polyester layer.

7. The method for chemically-and-mechanically polishing a semiconductor wafer surface according to claim 1 wherein said CMP polishing pad is provided with means to control localized pressure distribution.

8. A method for chemically-and-mechanically polishing a semiconductor wafer surface, comprising the steps of:

(a) providing a mechanical polishing pad;

(b) placing a pressure-sensitive film on top of a wafer surface to be polished by said mechanical polishing pad, said pressure-sensitive film contains materials that will show pressure-dependent characteristics when subject to an external pressure;

(c) commencing a chemically-and-mechanically polishing process so that said mechanical polishing pad exerts a pressure on said pressure-sensitive film;

(d) measuring said pressure-dependent characteristics on said pressure-sensitive film;

(e) converting said pressure-dependent characteristics into a pressure distribution; and (f) adjusting said mechanical polishing pad, or a leveling of said wafer, or both, according to said pressure distribution obtained in step (e).

9. The method for chemically-and-mechanically polishing a semiconductor wafer surface according to claim 8 wherein said pressure-sensitive film contains pressure-sensitive color materials that will show pressure-dependent colors when subject to an external pressure.

10. The method for chemically-and-mechanically polishing a semiconductor wafer surface according to claim 9 wherein said pressure-sensitive film contains a micro-encapsulated color forming layer and a color developing layer sandwiched by a pair of protective layers, and a color will be formed when said micro-encapsulated color forming layer is broken by an external pressure to release a color forming material which reacts with a color developing material contained in said color developing layer.

11. The method for chemically-and-mechanically polishing a semiconductor wafer surface according to claim 9 wherein said micro-encapsulated color forming layer is designed to contain a mixture microcapsules of different particle sizes so that their color-forming material will be released at a density that corresponds to the exerted pressure.

12. The method for chemically-and-mechanically polishing a semiconductor wafer surface according to claim 10 wherein said protective layer is a polymer layer.

13. The method for chemically-and-mechanically polishing a semiconductor wafer surface according to claim 10 wherein said protective layer is a polyester layer.

14. The method for chemically-and-mechanically polishing a semiconductor wafer surface according to claim 8 wherein said mechanical polishing pad is provided with means to control localized pressure distribution.

* * * * *